US010278431B2

(12) United States Patent
McClean

(10) Patent No.: US 10,278,431 B2
(45) Date of Patent: May 7, 2019

(54) SHAPEWEAR GARMENTS

(71) Applicant: Eldon McClean, Demarest, NJ (US)

(72) Inventor: Eldon McClean, Demarest, NJ (US)

( * ) Notice: Subject to any disclaimer, the term of this patent is extended or adjusted under 35 U.S.C. 154(b) by 288 days.

(21) Appl. No.: 15/224,013

(22) Filed: Jul. 29, 2016

(65) Prior Publication Data

US 2017/0027240 A1 Feb. 2, 2017

Related U.S. Application Data

(60) Provisional application No. 62/198,768, filed on Jul. 30, 2015.

(51) Int. Cl.

| | |
|---|---|
| ***A41C 1/00*** | (2006.01) |
| ***A41C 1/02*** | (2006.01) |
| ***A41C 1/06*** | (2006.01) |
| ***A41C 3/08*** | (2006.01) |
| ***A41D 1/08*** | (2018.01) |
| ***A41D 1/14*** | (2006.01) |
| ***A41B 9/06*** | (2006.01) |
| ***A41B 9/04*** | (2006.01) |

(52) U.S. Cl.

CPC ..... *A41C 1/003* (2013.01); *A41B 9/04* (2013.01); *A41B 9/06* (2013.01); *A41C 1/02* (2013.01); *A41C 1/06* (2013.01); *A41C 3/08* (2013.01); *A41D 1/08* (2013.01); *A41D 1/14* (2013.01); *A41B 2400/38* (2013.01); *A41D 2400/38* (2013.01)

(58) Field of Classification Search

CPC ..... A41C 1/003; A41C 1/0057; A41C 3/08; A41D 1/08; A41D 1/14; A41D 27/02; A41D 7/00; A41B 9/04; A41B 9/06

USPC ..... 2/227, 228, 238; 450/8, 19–21, 65, 66, 450/74–76

See application file for complete search history.

(56) References Cited

U.S. PATENT DOCUMENTS

| | | | | |
|---|---|---|---|---|
| 2,277,068 | A * | 3/1942 | Bulloch | A41B 9/04 2/408 |
| 2,651,040 | A * | 9/1953 | Block | A41D 7/00 450/30 |
| 3,233,432 | A | 2/1966 | Gordon et al. | |
| 3,395,712 | A | 8/1968 | Laguzzi | |
| 3,438,376 | A | 4/1969 | Murdock | |
| 3,856,599 | A | 12/1974 | Bylund | |
| 3,906,753 | A | 9/1975 | Siegfried | |
| 4,217,435 | A | 8/1980 | McConnell et al. | |
| 4,578,828 | A * | 4/1986 | Smith, Sr. | A41D 1/065 2/234 |
| 5,422,166 | A | 6/1995 | Fleischer | |
| 5,572,888 | A | 11/1996 | Browder, Jr. et al. | |
| 5,878,442 | A | 3/1999 | Pejak | |

(Continued)

OTHER PUBLICATIONS

International Preliminary Report on Patentability dated Feb. 8, 2018 in corresponding International Application No. PCT/US2016/044847.

(Continued)

*Primary Examiner* — Gloria M Hale

(74) *Attorney, Agent, or Firm* — Carter, DeLuca & Farrell, LLP

(57) ABSTRACT

The present application relates to shapewear garments, and particularly shapewear garments including multiple zones having varying layers, varying compressions, varying shapes, and/or varying temperature controls.

17 Claims, 19 Drawing Sheets

(56) References Cited

U.S. PATENT DOCUMENTS

| | | | |
|---|---|---|---|
| 5,902,170 | A | 5/1999 | Ganz |
| 5,953,754 | A | 9/1999 | Rosch et al. |
| 6,061,832 | A | 5/2000 | Morrison, Jr. |
| 6,071,578 | A | 6/2000 | Richardson et al. |
| 6,151,927 | A | 11/2000 | Owens et al. |
| 6,401,250 | B1 | 6/2002 | McNabb |
| 6,463,765 | B2 | 10/2002 | Blakely |
| 6,550,286 | B2 | 4/2003 | Querquant |
| 6,745,601 | B2 | 6/2004 | Pierelli |
| 6,817,037 | B1 | 11/2004 | King |
| 6,848,151 | B2 | 2/2005 | Bakker et al. |
| 6,871,516 | B2 | 3/2005 | Peeler et al. |
| 6,880,212 | B2 | 4/2005 | Bakker et al. |
| 6,886,367 | B2 | 5/2005 | Mitchell et al. |
| 7,017,376 | B2 | 3/2006 | Meckley et al. |
| 7,028,509 | B2 | 4/2006 | Mitchell et al. |
| 7,043,942 | B2 | 5/2006 | Chapman |
| 7,048,013 | B2 | 5/2006 | Shannon |
| 7,159,621 | B2 | 1/2007 | Shannon |
| 7,228,809 | B2 | 6/2007 | Angelino et al. |
| 7,405,170 | B2 | 7/2008 | Kong et al. |
| 7,546,751 | B2 | 6/2009 | Lutz |
| 7,578,148 | B2 | 8/2009 | McMurray |
| 7,752,681 | B2 | 7/2010 | Michel |
| 7,762,287 | B2 | 7/2010 | Liao |
| 7,774,865 | B2 | 8/2010 | Miller |
| 7,867,057 | B2 | 1/2011 | Scheininger et al. |
| 7,897,236 | B2 | 3/2011 | Merovitz |
| 7,905,117 | B2 | 3/2011 | Kronback |
| 8,096,149 | B1 | 1/2012 | Kronback |
| 8,123,590 | B2 | 2/2012 | MacKinnon |
| 8,176,864 | B2 | 5/2012 | Angelino et al. |
| 8,215,251 | B2 | 7/2012 | Welsch et al. |
| 8,220,499 | B2 | 7/2012 | Fukunishi et al. |
| 8,235,766 | B2 | 8/2012 | Melarti et al. |
| 8,276,216 | B2 | 10/2012 | Carney |
| 8,333,867 | B2 | 12/2012 | Pouchelon et al. |
| 8,360,816 | B2 | 1/2013 | Michel |
| 8,365,313 | B2 | 2/2013 | Greenblat |
| 8,425,275 | B2 | 4/2013 | Noel |
| 8,574,025 | B2 | 11/2013 | Kent |
| 8,586,489 | B2 | 11/2013 | Shteiyer |
| 8,597,760 | B2 | 12/2013 | Woods, II et al. |
| 8,646,459 | B2 | 2/2014 | Carlson et al. |
| 8,647,168 | B2 * | 2/2014 | Anvaripour ..... A41C 1/003 2/73 |
| 8,652,286 | B2 | 2/2014 | Shen et al. |
| 8,661,568 | B1 | 3/2014 | O'Brien |
| 8,695,115 | B2 | 4/2014 | Leyva |
| 8,726,700 | B2 | 5/2014 | Waldman et al. |
| 8,765,257 | B2 | 7/2014 | Weedlun |
| 8,769,718 | B2 | 7/2014 | Riehl |
| 8,827,764 | B2 | 9/2014 | Caruso et al. |
| 8,839,728 | B2 | 9/2014 | Angelino et al. |
| 2006/0025039 | A1 * | 2/2006 | Barbour ..... A41C 3/0057 450/1 |
| 2008/0072629 | A1 | 3/2008 | Gehring |
| 2010/0005560 | A1 | 1/2010 | Albizre |
| 2011/0061147 | A1 | 3/2011 | Welfeld |
| 2011/0120588 | A1 | 5/2011 | Shteiyer |
| 2011/0214216 | A1 * | 9/2011 | Zarabi ..... A41D 27/02 2/69 |
| 2012/0129425 | A1 | 5/2012 | Bevans |
| 2012/0144548 | A1 | 6/2012 | Quaranta |
| 2012/0222187 | A1 | 9/2012 | McLaren et al. |
| 2013/0095730 | A1 | 4/2013 | Jensen |
| 2013/0097764 | A1 | 4/2013 | Michel |
| 2014/0053322 | A1 | 2/2014 | Zamler |
| 2014/0235139 | A1 * | 8/2014 | Chayet ..... A41C 1/003 450/75 |
| 2014/0275906 | A1 | 9/2014 | Hackenburg |
| 2014/0310854 | A1 | 10/2014 | Kianmahd |
| 2015/0038052 | A1 | 2/2015 | Hays |
| 2015/0038938 | A1 | 2/2015 | Austin et al. |

OTHER PUBLICATIONS

International Search Report issued in corresponding International Application No. PCT/US2016/044847 dated Oct. 20, 2016, 3 pages.

* cited by examiner

540

740

870
845
845
840
860
872
855

860
845
860
860
872
860
855

SHAPEWEAR GARMENTS

CROSS REFERENCE TO RELATED APPLICATIONS

This application claims the benefit of U.S. Provisional Patent Application No. 62/198,768 filed on Jul. 30, 2015, the entire content of which is incorporated herein by reference.

FIELD

The present application relates to shapewear garments, and particularly shapewear garments including multiple zones having varying layers, varying compressions, varying shapes, and/or varying temperature controls.

BACKGROUND

Many women and men have parts of their bodies that they are unhappy with, making them insecure about wearing certain clothing. Foundation garments have been worn for a very long time to address this problem. Better known today as shapewear, these garments include body briefs, bodysuits, brassieres, control top panty hose, control panties, control briefs, control slips, control camisoles, control tanks, hip slips, waist shapers, corsets, garter belts, and girdles.

Shapewear garments are designed to change the wearer's shape, intending to produce a more fashionable, slim figure and to enhance the natural curves of the body. However, many of the previous shapewear garments do not provide an even distribution of the wearer's body, but rather produce areas where body fat may collect or be deposited.

In addition, the shapewear garments that may provide the most reshaping, may often further include a discomfort when worn due to the overly strong compression required and/or the heat generated by wearing such a strong or heavy garment.

Thus, there remains a need for shapewear garments which provide the proper amount of compression to provide the utmost reshaping while allowing the wearer to remain cool and not overheat.

SUMMARY

The present disclosure provides a variety of shapewear garments made of a unique geometric construction and including a variety of layers and/or compression zones which are designed to reshape the wearer of such garment while maintaining a comfortable clothing experience. The garments include multiple overlapping layers connected to another via a plurality of seams which define the different zones.

In embodiments, the shapewear garments include a plurality of zones which display different compression strengths allowing for more compression in certain zones, such as the zones nearest the fat or flabby problem areas of a person's body, and less compression in other zones, such as the zones nearest the more muscular or trim areas of a person's body.

In embodiments, the shapewear garments include a plurality of zones which include a different number of layers of stretchable material per zone. In embodiments, the zones which include more layers provide more compression and less breathability to the wearer and the zones which include less layers provide less compression and more breathability to the wearer.

In embodiments, the shapewear garments include a plurality of zones which display different thicknesses and porosities thereby providing a first zone which may be more porous and cooling to the wearer and a second type of zone which includes more overlapping layers, but more compressive causing fat burning.

In embodiments, the shapewear garment displays sufficient compression that the garment assists with appetite control by limiting the expansion of the stomach.

BRIEF DESCRIPTION OF THE DRAWINGS

For the purposes of illustrating the present disclosure, there is shown in the drawings an illustrative form, it being understood however, that the invention is not intended to be limited to the precise form shown by the drawings in which.

DETAILED DESCRIPTION

Figure 1A:
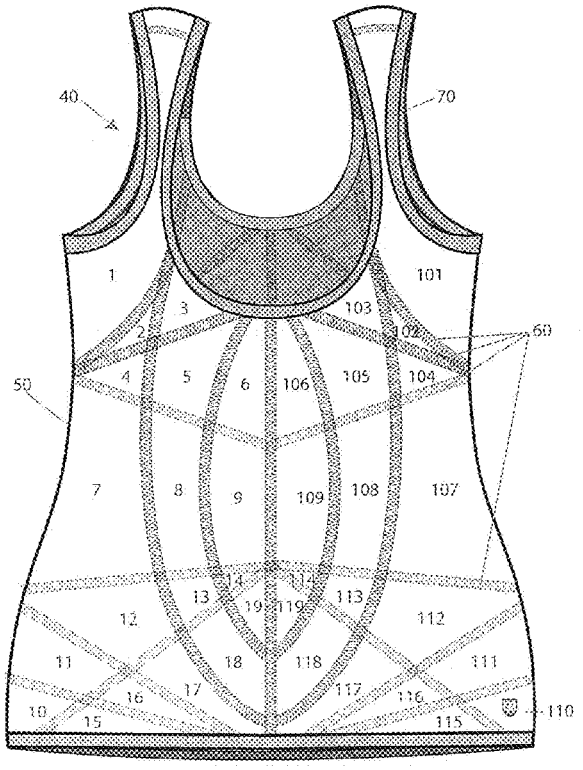
FIGS. 1A-1B are front and rear views of a shapewear garment configured as a camisole according to at least one embodiment described in the present disclosure.
Figure 1B:
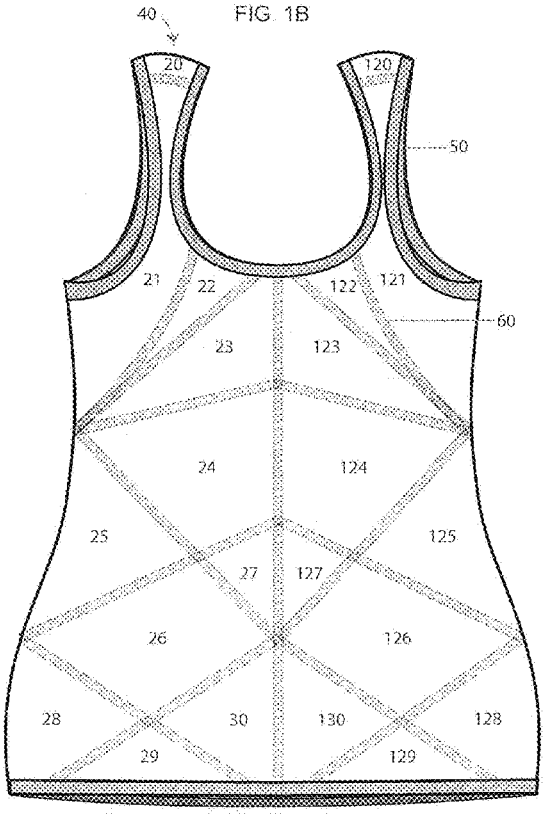

The present disclosure provides a variety of shapewear garments made of a unique geometric construction and including a plurality of zones, wherein each individual zone may vary in thickness, such as by the number of layers, and/or may vary in shape, compression strength, appetite control, porosity, and/or temperature control.

The body of the shapewear garment is made from multiple overlapping layers of at least one elastic or stretchable material and includes a plurality of seams which attach the multiple layers along the seams thereby defining the perimeter of the various zones.

The body of the shapewear garment is available in a variety of garment formats including, but not limited to: camisoles or tank tops; shirts; pants; shorts; body suits, with or without shoulder straps, arm sleeves, pant legs, and feet covers; panties; corsets; brassieres, and combinations thereof.

In addition, the shapewear garments may be available in any size as defined by standardized sizing systems or catalog sizes, and usually denoted on a tag or label affixed to garments that are sold off-the-shelf. In the United States, garment sizes are typically denoted numerically (e.g., 0, 2, 4, 6, 8, 10, 12, 14, 16, 18, 20, 22, 24, etc.) or alphabetically (e.g., extra-small (XS), small (S), medium (M), large (L), extra-large (XL), double extra-large (XXL), triple extra-large (XXXL), etc.). Sizes may also refer to a combination of numerical or alphabetical sizes, such a small-medium (S-M), or large to extra-large (L-XL), or any other combination of consecutive sizes. Also, the shapewear garments described herein may be without a general size and may alternatively be tailored or hand-made on an individual basis specifically tailored to an individual's body dimensions.

Any combination of suitable elastic and/or stretchable material(s) may be used to form the multilayer body. By elastic or stretchable, the material is capable of being stretched at least in a longitudinal direction when a force is applied thereto, such as a portion of a wearer's body weight, while also being able to recover and/or return to the original shape and/or configuration when the force is removed. In embodiments, the materials that form the main body of the shapewear garment may include, but not be limited to, sheets of polyamides, including nylon, and polyester-polyurethanes, such as spandex, and combinations thereof.

In embodiments, the materials that form the body of the shapewear garment may include, but not be limited to, a blend of a polyamide (PA) and a polyester-polyurethane (PE-PU) material wherein the PA represents from 5-95% of the PA/PE-PU blend, more specifically from 20-80% of the PA/PE-PU blend, more specifically from 50-70% of the PA/PE-PU blend and in particular embodiments, the PA represents 60-69% of the PA/PE-PU blend. The PE-PU material alone or in combination with any variety of additional optional materials may represent the remaining percentages of the PA/PE-PU blends previously described. For example, a PA/PE-PU blend may include 60-69% PA and 31-40% PE-PU, or in another example, a PA/PE-PU blend may include 60-69% PA, 30-35% PE-PU and 1-10% of an additional optional material, such as a reinforcing material, wicking material, dye, etc.

In embodiments, the materials that form the body of the shapewear garment may include, but not be limited to, a blend of nylon and spandex materials wherein the nylon represents from 5-95% of the nylon/spandex blend, more specifically from 20-80% of the nylon/spandex blend, more specifically from 50-70% of the nylon/spandex blend and in particular embodiments, the nylon represents 60-69% of the nylon/spandex blend. Spandex alone or in combination with any variety of additional optional materials may represent the remaining percentages of the nylon/spandex blends previously described. For example, a nylon/spandex blend may include 60-69% nylon and 31-40% spandex, or in another example, a nylon/spandex blend may include 60-69% nylon, 30-35% spandex and 1-10% of an additional optional material, such as a reinforcing material, wicking material, dye, etc.

In some embodiments, the body may include multiple layers of the same material, i.e., polyamide, polyester-polyurethane, nylon, spandex, and/or combinations thereof. In other embodiments, the body includes multiple layers of different materials, i.e., a first layer of nylon and a second layer of spandex and/or a first layer of a nylon/spandex blend having a first concentration of nylon, and second layer of a nylon/spandex blend having a different concentration of nylon.

In embodiments, at least one layer of the multiple layers of the body includes a polyamide, for example nylon. In embodiments, every layer of the multiple layers of the body includes a polyamide, for example nylon.

In embodiments, at least one layer of the multiple layers of the body includes a polyester-polyurethane, for example spandex. In embodiments, every layer of the multiple layers of the body includes a polyester-polyurethane, for example spandex.

In embodiments, at least one layer of the multiple layers of the body includes a blend including a polyamide, for example nylon, and a polyester-polyurethane, for example spandex. In embodiments, every layer of the multiple layers of the body includes blend including a polyamide, for example nylon, and a polyester-polyurethane, for example spandex.

In forming the multilayer body, a plurality of layers of the elastic or stretchable material(s) may be stacked and/or combined. The shapewear garment may include any number of layers. In embodiments, the shapewear may include from 1-20 layers, from 2-15 layers, from 3-10 layers and in particular embodiments, the shapewear may include from 4-8 layers. In embodiments, the number of layers is intended to represent maximum number of layers in the body and thus does not necessarily represent the least number of layers provided in each zone. For example, a body made from 5 layers will include a maximum of 5 layers in any zone, but may include zones wherein not all 5 layers overlap and thus includes less than 5 layers, such as 1-4 layers.

At least two of the layers will be of a different shape, configuration, and/or display a different amount of surface area when combined with the other layers to produce different zones within the body, each including a different number of layers. It is envisioned that as the number of layers increases in a zone, the compression strength and/or the ability of the zone to suppress a wearer's appetite is enhanced. It is further envisioned that as the number of layers decreases in a zone, the level of open porosity will increase in the zone due to less occlusion of the pores by the additional layers, and thereby provide a cooling effect in the zone. Thus, zones which include a higher number of layers can be positioned in the areas of the garment body where more compression may be needed such as along the waistline, around the thighs, near the stomach, and/or by the hips. While zones which include less layers may be positioned in other areas of the garment body to provide a lighter overall garment which is more comfortable and allows for the cooling effect of these zones to prevent or minimize overheating and/or sweating, such as the shoulders and armpit areas.

Each layer will display a certain longitudinal elasticity and/or stretchability which represents the ability of each individual layer to be stretched along a longitudinal length of the material when a force is applied thereto, while maintaining some ability to return to its original shape/size/configuration when the force is removed. In some embodiments, the individual layers may be stacked one on top of another, each layer laid in the same orientation relative to the longitudinal elasticity of each layer. In other embodiments, the individual layers may be stacked one on top of another such that at least some layers lay in an orientation different from other layers in the stack relative to the longitudinal elasticity of each layer.

In certain embodiments, the individual layers may be stacked one on top of another, such that each neighboring layer of the stack is oriented differently relative to the longitudinal elasticity of each layer. For example, a second layer may be placed next to a first layer, wherein the second layer is rotated any amount relative to the first layer such that the longitudinal elasticity of the second layer lies in a different direction from the longitudinal elasticity of the first layer. The zones having more layers stacked in a different orientation display more compression strength and/or appetite control than zones having less layers stacked in a different orientation in a particular zone.

Figure 11:
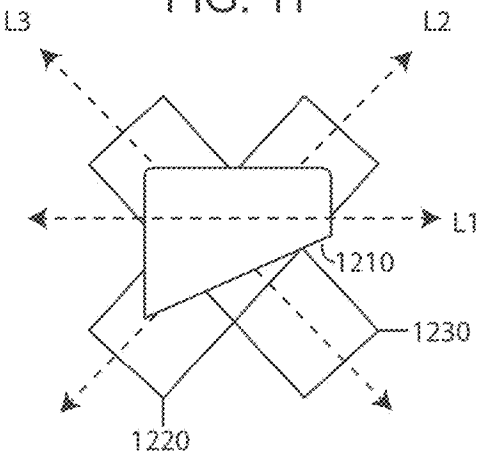
FIG. 11 is a top view of multiple rotated layers of the shapewear garment according to at least one embodiment described in the present disclosure.

As shown in FIG. 11, a first, second, and third layers 1210, 1220, 1230 are stacked representing a zone, wherein the three layers are flat and lie in parallel planes. As further shown in FIG. 11, the longitudinal elasticity L1 of the first layer 1210 lies in a different orientation or direction than the longitudinal elasticity L2 of the second layer 1220 and the longitudinal elasticity L3 of the third layer 1230.

The rotation between layers can range from 0.1 degree to 360 degrees and in embodiments from 1 to 180 degrees. In embodiments, the rotation of the longitudinal elasticity of the layers may represent from 5-135 degrees. In particular embodiments, the different layers can be rotated from 45-90 degrees relative to one another and specifically to neighboring layers, based on the longitudinal elasticity of each of the layers. It is envisioned that any combination of layers of the same or different orientation may be used. It is further envisioned that the compression force which can be applied by the multilayer body increases as the number of layers which are oriented differently increases in a certain zone.

In embodiments, the individual layers may stretch longitudinally from 10 to 90%, in embodiments from 20 to 80%, and in embodiments from 30 to 70% before break.

In embodiments, the individual layers may be formed by any suitable manner known to those skilled in the art, including but not limited to knitting, weaving, braiding, molding, extruding, casting, and combinations thereof. In embodiments, the layer(s) is knit. In embodiments, the layer(s) is molded.

In embodiments, the layer(s) includes a plurality of pores. The pores may be evenly distributed across the individual layer(s). It is envisioned that the pores allow the stretchable material to provide compression in combination with an openness or breathability which allows for better temperature control. It is further envisioned that as the number of layers that are stacked on top of each other increases, the porosity in the multiple overlapping layers, collectively, decreases thereby decreasing the garments ability to release body temperature away from the wearer. It is further envisioned that as the number of layers that are stacked on top of each other decreases, the porosity in the multiple overlapping layers, collectively, increases thereby increasing the garments ability to release body temperature away from the wearer.

Once the layers are stacked and/or combined and possibly oriented differently, a plurality of seams is provided to the body of the shapewear garment. In embodiments, the seams are formed by stitching. In embodiments, the seam may include from 5-50 stitches per inch. In embodiments, the seam may include from 10-30 stitches per inch. In embodiments, the seam may include from 15-25 stitches per inch. In embodiments, the seam may include 19 or 20 stitches per inch. It is envisioned that the number of stitches for the seam may vary along the plurality of seams used to form the zones of the body.

By combined, the multiple individual layers may be connected to each other, not only along the seam, but also across the zone defined within the seam.

By stacked, the multiple individual layers may be connected to each other by the seam, but remain free of each other across the zone defined within the seam.

In other embodiments, the seams may be formed with adhesives and/or heat pressing. The seams are provided along the perimeter of the areas or zones of body which include a different number of layers. The seams may pass through all the layers in the garment body or alternatively pass through only some of the layers of the garment body. In embodiments, the seams completely surround each area or zone. In other embodiments, the seams surround only a portion of the perimeter of each area or zone and the seam is attached to an outer edge of the garment, which may be positioned near an opening of the garment, for example, for passage of a wearer's neck, arm, and/or leg.

The body of the shapewear garments described herein includes a plurality of zones, and the zones may vary in shape, thickness, and/or compression strength. In embodiments, the body includes a plurality of different compression zones, wherein the compression strength may be different in some of the compression zones. The compression zones are created and/or defined by the seams which surround, at least partially, the areas of the body which include a different number of stacked and/or combined layers.

The body of the shapewear garment will include any number of compression zones. In embodiments, the shapewear garment may include from about 1 to about 250 compression zones, from about 2-200 compression zones, from 3-150 compression zones, from about 4-100 compression zones, or from about 5-90 compression zones. In particularly embodiments, the shapewear garment may include from 10-100 different compression zones, from about 20-95 compression zones, from about 40-90 compression zones, or from about 15-30 different compression zones. The compression zones being of various shapes, configurations, and/or sizes.

In embodiments, the compression zones may be symmetrically distributed across the body of the shapewear garment. In other embodiments, the compression zones may be asymmetrically distributed across the body of the shapewear.

The compression zones of higher compression may be placed to target specific problem areas of a person's body, such as the inner thigh, the torso, the underarms, the chest, the lower back, etc., where excess body tissue or fat may amass.

Each of the zones will display a certain level of compressive force. The compressive force per zone may range from 0.1 to 1000 pounds per square inch. In embodiments, compressive force per zone may range from 0.5 to 100 pounds per square inch. In embodiments, compressive force per zone may range from 0.75 to 25 pounds per square inch.

In the embodiments illustrated in FIGS. 1A-9E, the shapewear garments generally comprise a body made of at least one elastic and/or stretchable fabric and may also include various optional components, such as lace, elastic bands, belts, fasteners, buckles, decorative materials, and the like. The fabrics that form the body of the garment may be made from stretchable materials such as nylon, spandex, and combinations thereof. In embodiments, the shapewear garments may be made from a blend of 60-69% nylon and 31-40% spandex materials weighing in the range from about 1-5 oz/yd$^2$, and particularly 2-3 oz/yd$^2$ and more particularly 2.8 oz/yd$^2$.

As further provided in FIGS. 1A-9E, the shapewear garments described herein may further include a variety of additional items. For example, the outer edge of the garment may include a material bonded in some manner to the outer perimeter of the body selected from a felt material, a silicone material, and combinations thereof. It is envisioned that the material and/or combination of materials may provide support and/or comfort to the wearer while preventing the garment from slipping on the wearer's body. The material(s) may also prevent the edge of the fabric from unraveling or fraying while providing a seamless look when worn under a wearer's form-fitting attire. For example, the material of the outer edge may include two separate materials which can be positioned around the leg openings, the shoulder straps, the arm sleeve openings, the neckline, and/or around the midriff of the wearer.

Figure 1C:
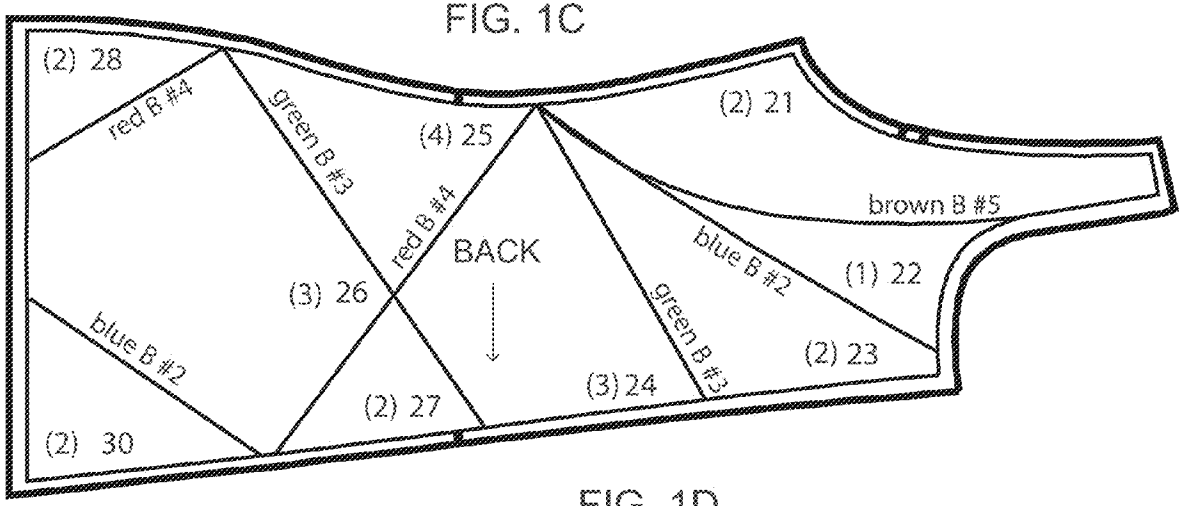
FIGS. 1C-1E are schematic drawings of a shapewear garment configured as a camisole according to at least one embodiment described in the present disclosure.
Figure 1D:
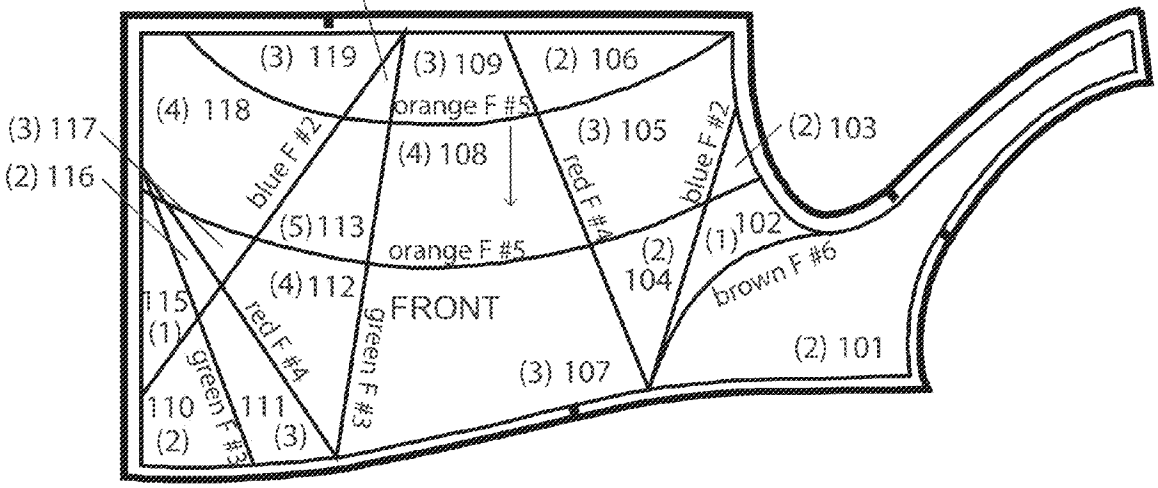

In the embodiments illustrated in FIGS. 1A-1D, the shapewear garment 40 of the present disclosure is configured as a camisole. The shapewear garment 40 has a main body 50 made from multiple layers of stretchable material(s) described above. Although described as including multiple layers, some zones of the body garment may also include only a single layer of stretchable material along with the plurality of zones which include multiple layers. The shapewear garment 40 further includes a plurality of seams 60 (darker lines—reference no. 60 is not connected to all the seams but rather is intended to indicate an example of the seams) which connect the overlapping layers of material and create zones 1-30 and 101-130 therebetween. The various zones differ by: the number of layers of material provided within each zone; the level of compression provided in each zone; the level of appetite control each zone may apply; and/or the level of temperature control, such as a cooling effect, each zone provides. For example, as depicted in FIGS. 1C and 1D, each zone 21-30 and 101-119 includes a different number of layers of material (indicated by the number in parentheses in each zone). As noted herein, the higher the number of layers in a zone, typically the higher the compressive force in that zone. In embodiments, some zones include only a single layer of porous material and such zones are considered vented zones which allow for the most release of wearer's body temperature and moisture. For example, zones 22 and 115 are shown to include only 1 layer of material and thus are considered vented zones. In embodiments, the body of the shapewear garment includes at least one vented zone. In embodiments, the body of the shapewear garment includes a plurality of vented zones. The vented zones may be symmetrically positioned on the body.

In addition, the shapewear garment 40 includes an outer edge 70 positioned along the openings for the arms, neck and torso of the wearer.

As shown in FIG. 1A, the shapes of zones 1-19 on the left front side of body 40 are symmetrical to the shapes of zones 101-119 on the right front side of the body 40. For example, the shape of zone 1 is symmetrical to the shape of zone 101. As further shown in FIG. 1B, the shapes of zones 20-30 on the left back side of body 40 are symmetrical to the shapes of zones 120-130 on the right back side of the body 40. For example, the shape of zone 26 is symmetrical to the shape of zone 126.

In some embodiments, at least two of the zones which are symmetrical shapes of each other include a different number of layers of stretchable material. For example, in embodiments, zone 26 may include 5 layers of stretchable material while symmetrical zone 126 includes 6 layers of stretchable material. In other embodiments, all of the zones which are symmetrical shapes of each other include a different number of layers of stretchable materials relative to each other.

In some embodiments, at least two of the zones which are symmetrical shapes of each other include the same number of layers of stretchable material. For example, in embodiments, zones 26 and 126 may each include 5 layers of stretchable material. In other embodiments, all of the zones which are symmetrical shapes of each other include the same number of layers of stretchable materials relative to each other.

Although not shown, the shapewear garments described herein may further include an inner lining, separate from the layers of the body, which provides a more comfortable feel to the wearer and is positioned between the inside of the garment and the wearer's skin.

Figure 1E:
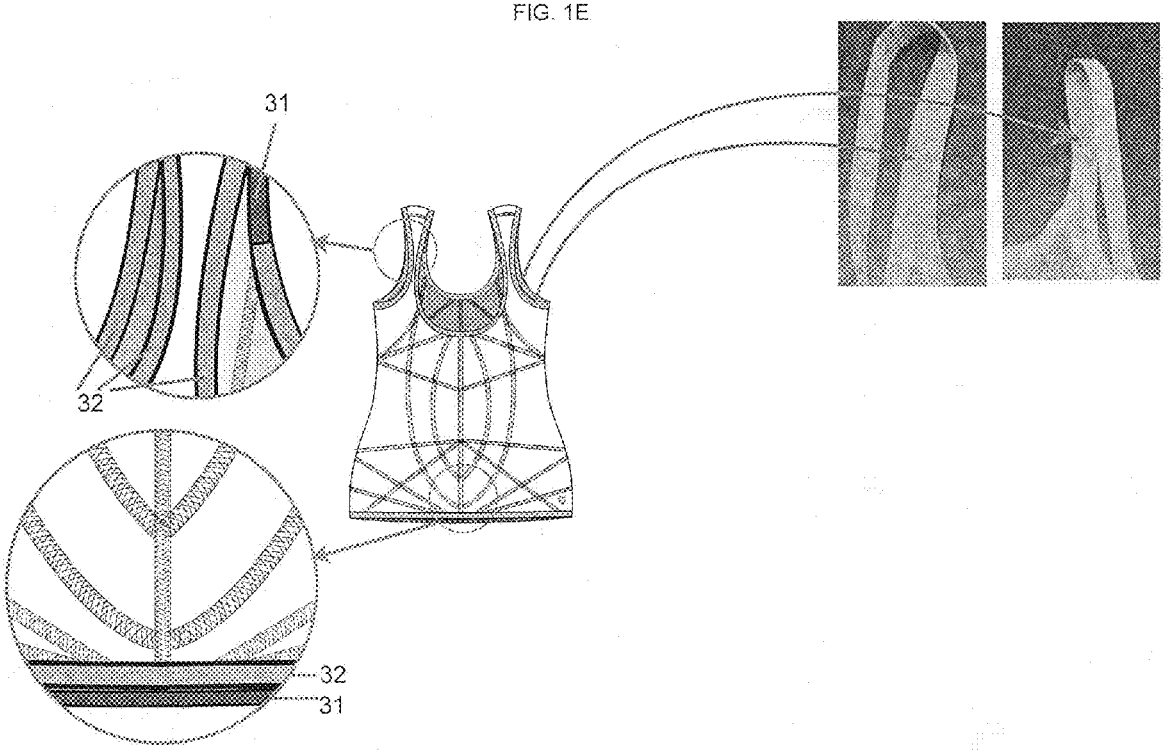

FIG. 1E further illustrates that in some embodiments, the body may include an outer edge may include both a silicone material 31 and a felt material 32 bonded along the perimeter of any openings in the body of the shapewear garment.

Figure 2A:
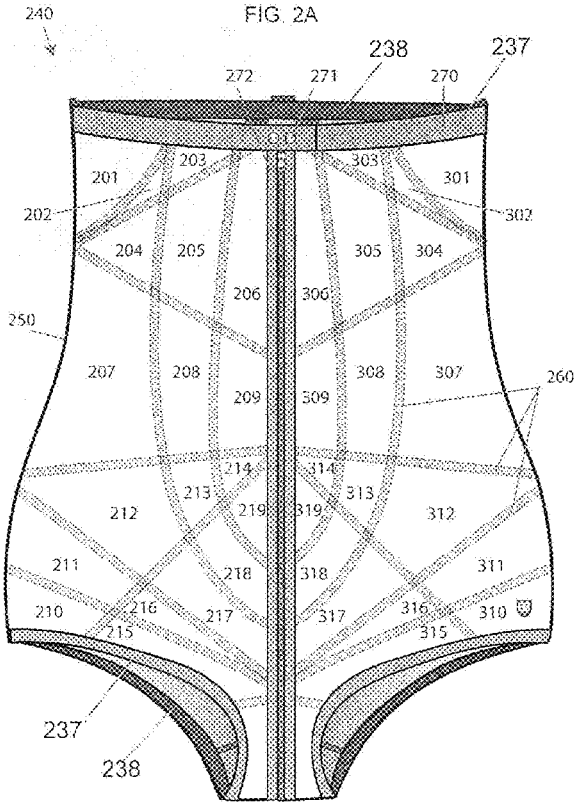
FIGS. 2A-2B are front and rear views of a shapewear garment configured as a corset according to at least one embodiment described in the present disclosure.
Figure 2B:
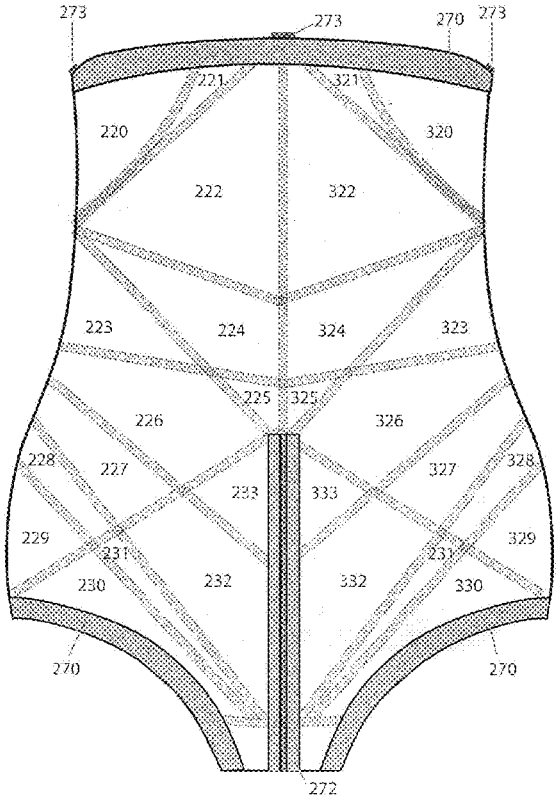
Figure 2C:
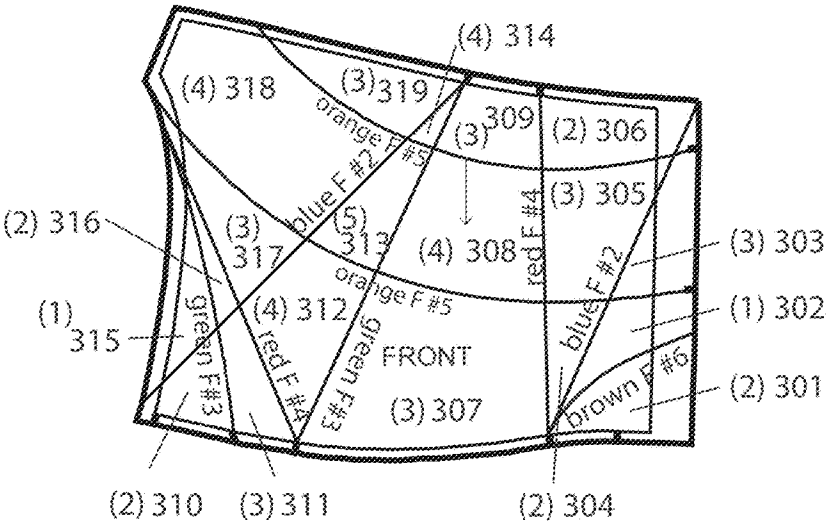
FIGS. 2C-2D are schematic drawings of a shapewear garment configured as a corset according to at least one embodiment described in the present disclosure.

In FIGS. 2A-2C, the shapewear garment 240 is configured as a corset (with possible panty combination). The shapewear garment 240 has a main body 250 made from the multilayer material(s) described above. The shapewear garment 240 further includes a plurality of seams 260 (reference no. 260 is not connected to all the seams but rather is intended to indicate an example of the seams) which connect the overlapping layers of stretchable material and create zones 201-233 and 301-333 therebetween. The various zones differ by: the number of layers of material provided within each zone; the level of compression provided in each zone; the level of appetite control each zone may apply; and/or the level of temperature control, such as a cooling effect, each zone provides. For example, as depicted in FIG. 2C, each zone 301-319 includes a different number of layers of material (indicated by the number in parentheses in each zone). In addition, the shapewear garment 240 includes an outer edge 270 positioned along the openings for the legs and around the midriff area of the wearer. The outer edge 270 may include both a silicone material 238 and a felt material 237 bonded along the perimeter of the shapewear garment 240.

As shown in FIG. 2A, the shapes of zones 201-219 on the left front side of body 250 are symmetrical to the shapes of zones 301-319 on the right front side of the body 250. For example, the shape of zone 201 is symmetrical to the shape of zone 301. As further shown in FIG. 2B, the shapes of zones 220-233 on the left back side of body 250 are symmetrical to the shapes of zones 320-333 on the right back side of the body 250. For example, the shape of zone 233 is symmetrical to the shape of zone 333.

In some embodiments, at least two of the zones which are symmetrical shapes of each other include a different number of layers of stretchable material. For example, in embodiments, zone 226 may include 3 layers of stretchable material while symmetrical zone 326 includes 6 layers of stretchable material. In other embodiments, all of the zones which are symmetrical shapes of each other include a different number of layers of stretchable materials relative to each other.

In some embodiments, at least two of the zones which are symmetrical shapes of each other include the same number of layers of stretchable material. For example, in embodiments, zones 226 and 326 may each include 4 layers of stretchable material. In other embodiments, all of the zones which are symmetrical shapes of each other include the same number of layers of stretchable materials relative to each other Shapewear garment 240 further includes a zipper 272 which extends from the center of the front of the body 250 to the center of the back of body 250 to waist level. Such a design provides for the shapewear garment to be easily slipped on and/or off via the zipper and allows for easy toilet usage without the need to remove the entire garment. Buckles 273 are also illustrated and are positioned near the top of the shapewear garment 240. The buckles are so situated to allow a wearer to connect another garment, such as a brassiere, to the shapewear garment 240.

Shapewear garment 240 also includes a fastener 271 positioned in the outer edge 271 of the garment 240 such as a rivet, button or snap for tightening of the outer edge 271 around the midriff of the wearer. Additional fasteners may be positioned on the outer edge 271 of the garment 240 along the openings along the legs (not shown).

Figure 3C:
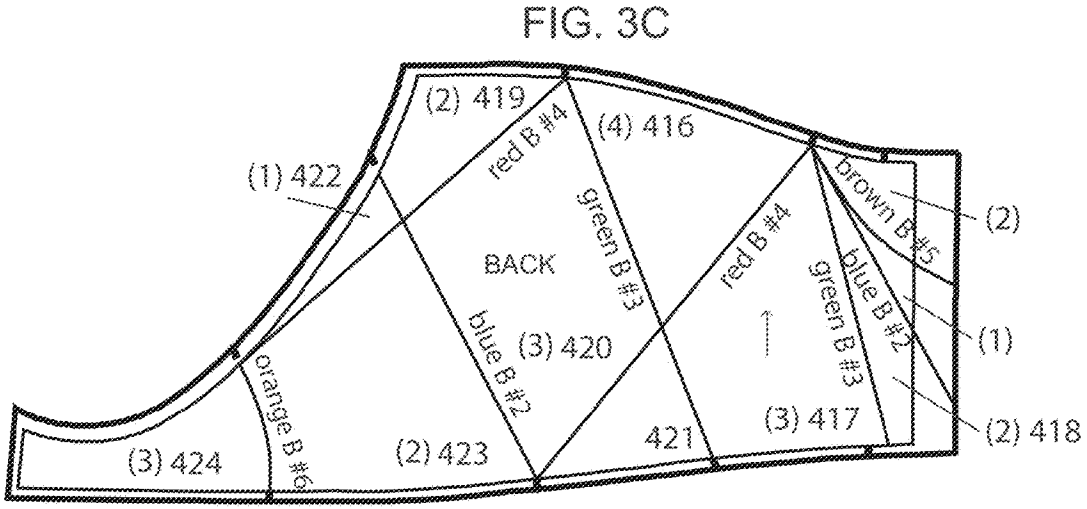
FIGS. 3C-3D are schematic drawings of a shapewear garment configured as a panty according to at least one embodiment described in the present disclosure.
Figure 3A:
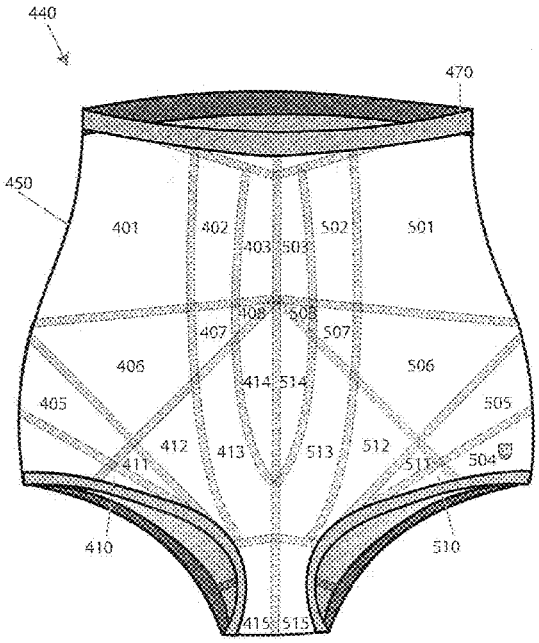
FIGS. 3A-3B are front and rear views of a shapewear garment configured as a panty according to at least one embodiment described in the present disclosure.
Figure 3B:
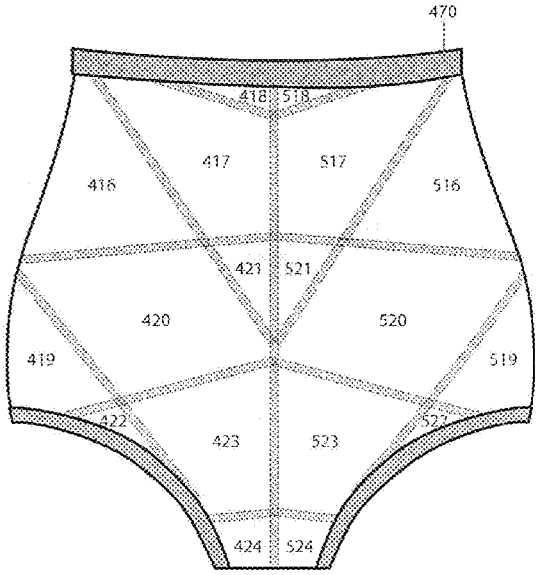

In the embodiments illustrated in FIGS. 3A-3C, the shapewear garment 440 is configured as a panty which extends near or above the navel. The shapewear garment 440 has a main body 450 made from the multilayer stretchable material(s) described above. The shapewear garment 440 further includes a plurality of seams 460 (reference no. 460 is not connected to all the seams but rather is intended to indicate an example of the seams) which connect the overlapping layers of material and create zones 401-424 and 501-524 therebetween. The various zones differ by: the number of layers of material provided within each zone; the level of compression provided in each zone; the level of appetite control each zone may apply; and/or the level of temperature, such as a cooling effect, each zone provides. For example, as depicted in FIG. 3C, each zone 416-424 includes a different number of layers of material (indicated by the number in parentheses in each zone). In addition, the shapewear garment 440 includes an outer edge 470 positioned along the openings for the legs around the waistline near or above/around the navel area of the wearer.

Figure 2D:
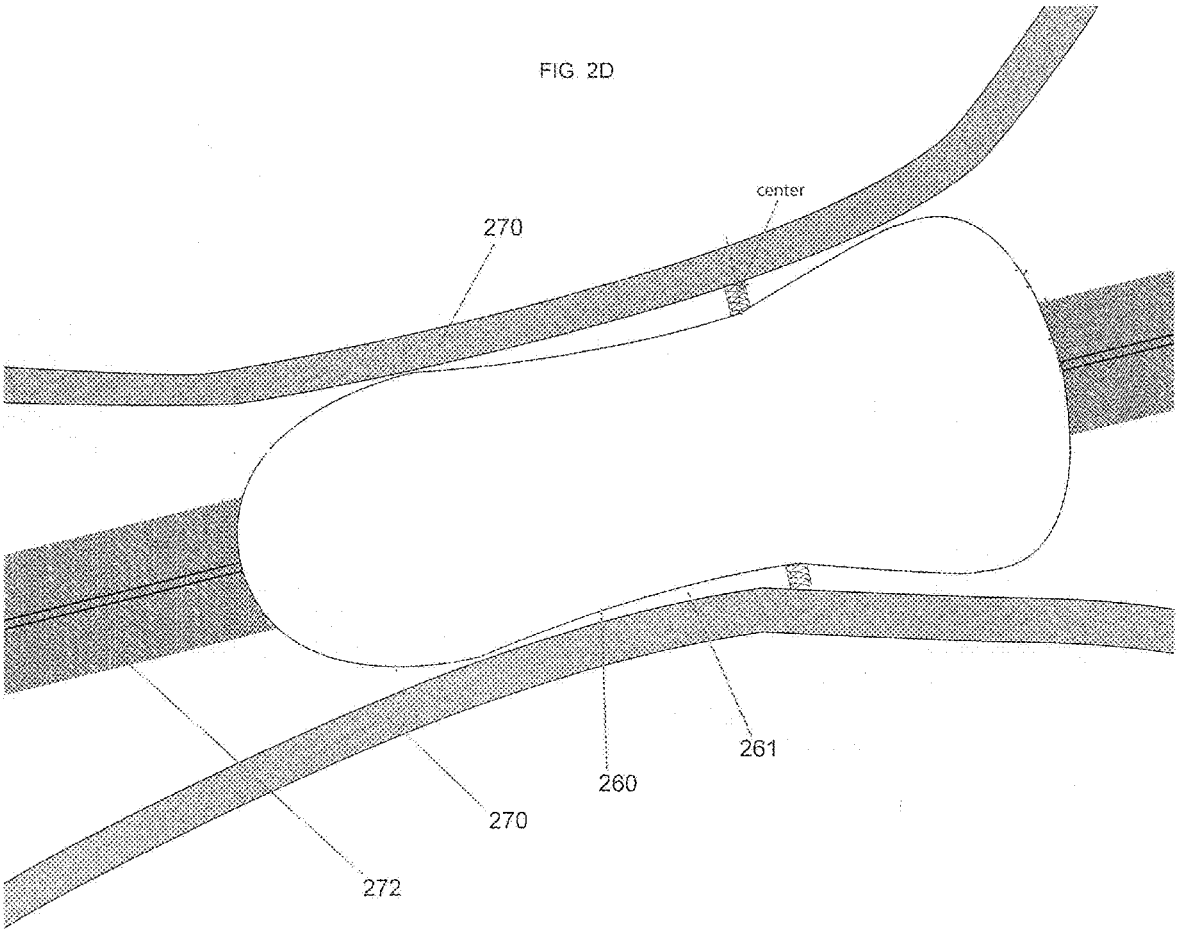
Figure 3D:
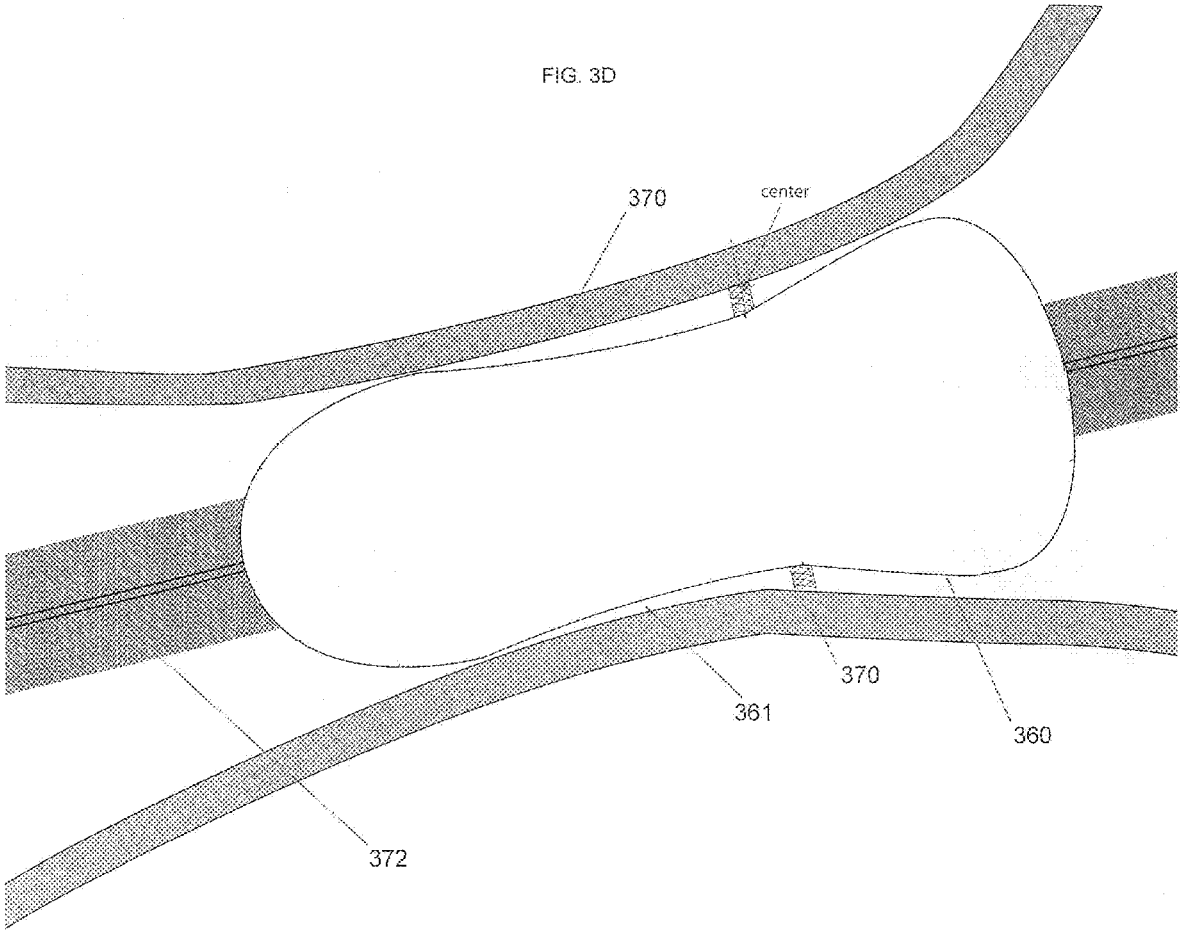

FIGS. 2D and 3D further illustrate a removable panty shield 260, 360 which can be removably attached to a crotch portion 261, 361 of the shapewear garment 240, 340. The shield 260, 360 may be made of any biocompatible material. In embodiments the shield 260, 360 may be made of cotton and/or any material suitable for absorbing moisture and/or fluids. The shield is intended to be removable for cleaning and sanitizing purposes and may further be useful in protecting a wearer's crotch area during the zipping and/or unzipping of the zipper. The shield may be removably connected to the shapewear garment using a connector, such as rivet, button, snap, Velcro®, buckle, zipper, and the like. It is envisioned that the panty shield may be included in any of the garments described herein that include a crotch portion to attach thereto.

Figure 4A:
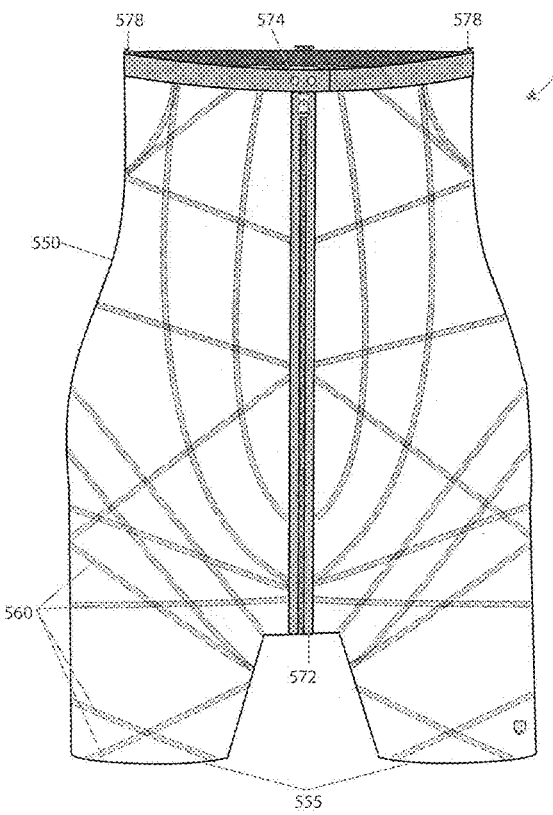
FIGS. 4A-4B are front and rear views of a shapewear garment configured as a corset with pant legs according to at least one embodiment described in the present disclosure.
Figure 4B:
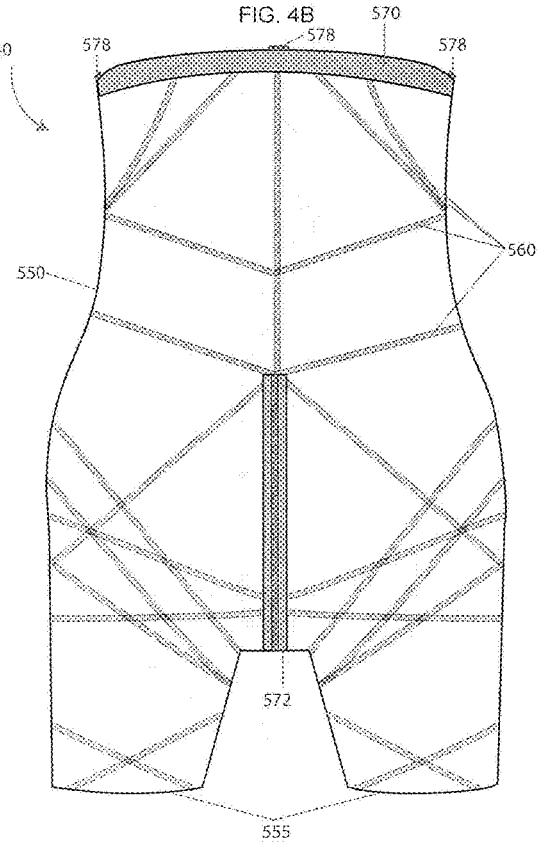

FIGS. 4A-4B depict a shapewear garment 540 which is configured as a corset including pant legs 555 which extend down the leg of the wearer to an area near the thighs or knee. Garment 540 includes a multilayer body 550 including a variety of zones, similar in fashion to those zones described herein and/or depicted in the previous figures. Garment 540 further includes an outer edge 570, a zipper 572, at least one fastener 574 and at least one buckle 578.

FIGS. 5A-8A depict some additional embodiments wherein the shapewear garment 640, 740, 840, and 940 is configured as a body suit, with or without shoulder straps, arm sleeves, and/or pant legs.

Figure 5A:
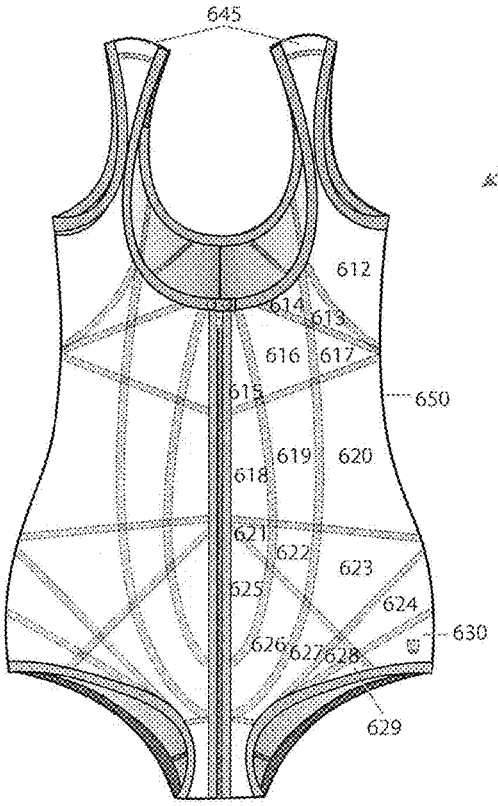
FIGS. 5A-5B are front and rear views of a shapewear garment configured as a body suit with shoulder straps according to at least one embodiment described in the present disclosure.
Figure 5A:
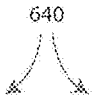
Figure 5B:
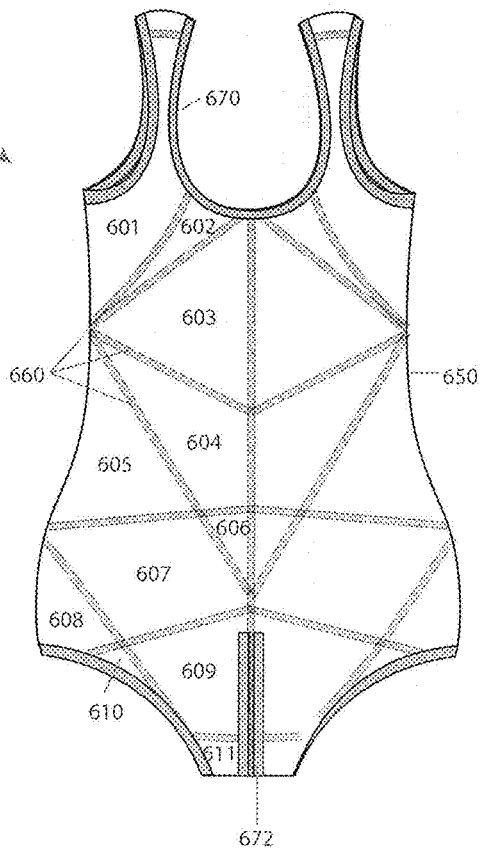
Figure 5C:
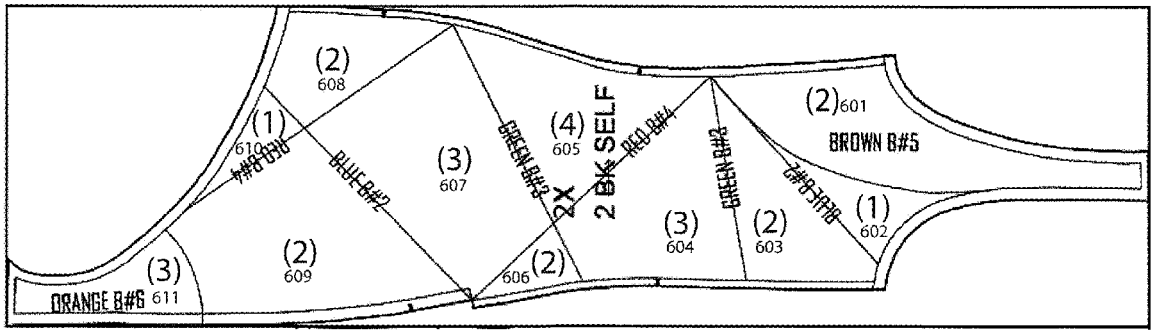
FIGS. 5C-5D are schematic drawings of a shapewear garment configured as a body suit with shoulder straps according to at least one embodiment described in the present disclosure.
Figure 5D:
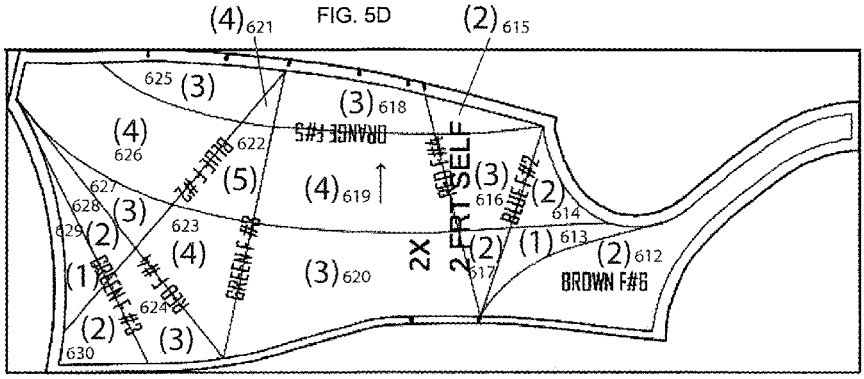

In the embodiments illustrated in FIGS. 5A-5D, the shapewear garment 640 of the present disclosure is configured as a body suit with shoulder straps 645 and free of arm sleeves or pant legs. The shapewear garment 640 has a main body 650 made from the multilayer stretchable material(s) described above. The shapewear garment 640 further includes a plurality of seams 660 (reference no. 660 is not connected to all the seams but rather is intended to indicate an example of the seams) which connect the overlapping layers of material and create zones 601-630 therebetween. The various zones differ by: the number of layers of material provided within each zone; the level of compression provided in each zone; the level of appetite control each zone may apply; and/or the level of temperature, such as a cooling effect, each zone provides. For example, as depicted in FIGS. 5C and 5D, zones 601-630 include a different number of layers of material (indicated by the number in parentheses in each zone). In addition, the shapewear garment 640 includes an outer edge 670 positioned along the openings for the arms, shoulders, neck, and legs of the wearer to pass therethrough.

Figure 6A:
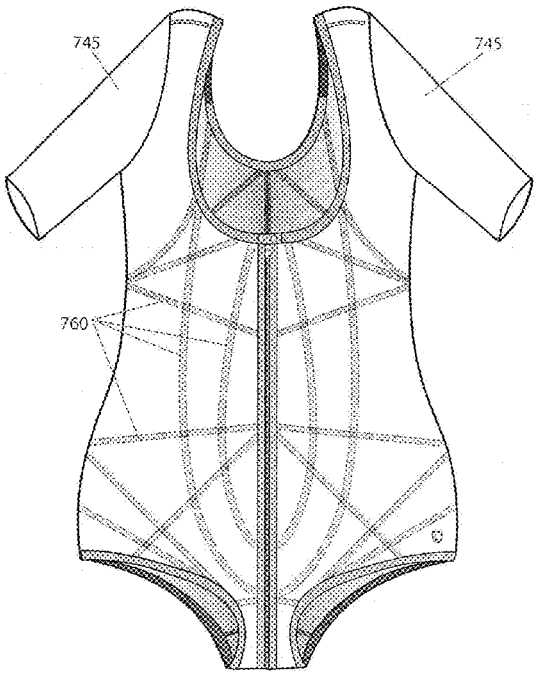
FIGS. 6A-6B are front and rear views of a shapewear garment configured as a body suit with arm sleeves according to at least one embodiment described in the present disclosure.
Figure 6B:
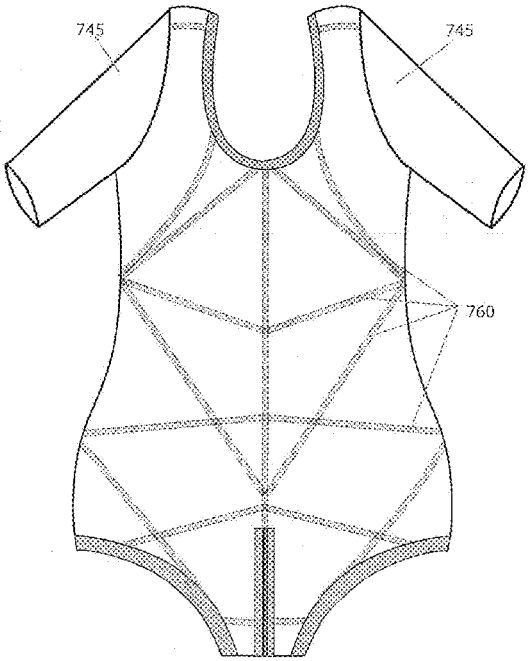

FIGS. 6A-6B depict a front and rear view of another embodiment wherein the shapewear garment 740 further includes sleeves 745 for receipt of a wearer's arms. Sleeves 745 extend from body 750 which also includes seams 760, outer edge 770, and zipper 772. Seams 760 define a plurality of zones, similar in fashion to the zones described herein and/or depicted in the previous figures.

As shown, the arms 745 do not appear to include any seams 760 and therefore represent either a single zone and/or are made of a material separate from the body 740. It is envisioned however, that in some embodiments, the seams 760 may be further added to the sleeve to further provide multiple zones to the sleeves and that such embodiments may be conducive to reshaping the fatty tissue commonly found in the lower part of the upper arm.

Figures 7A, 7B:
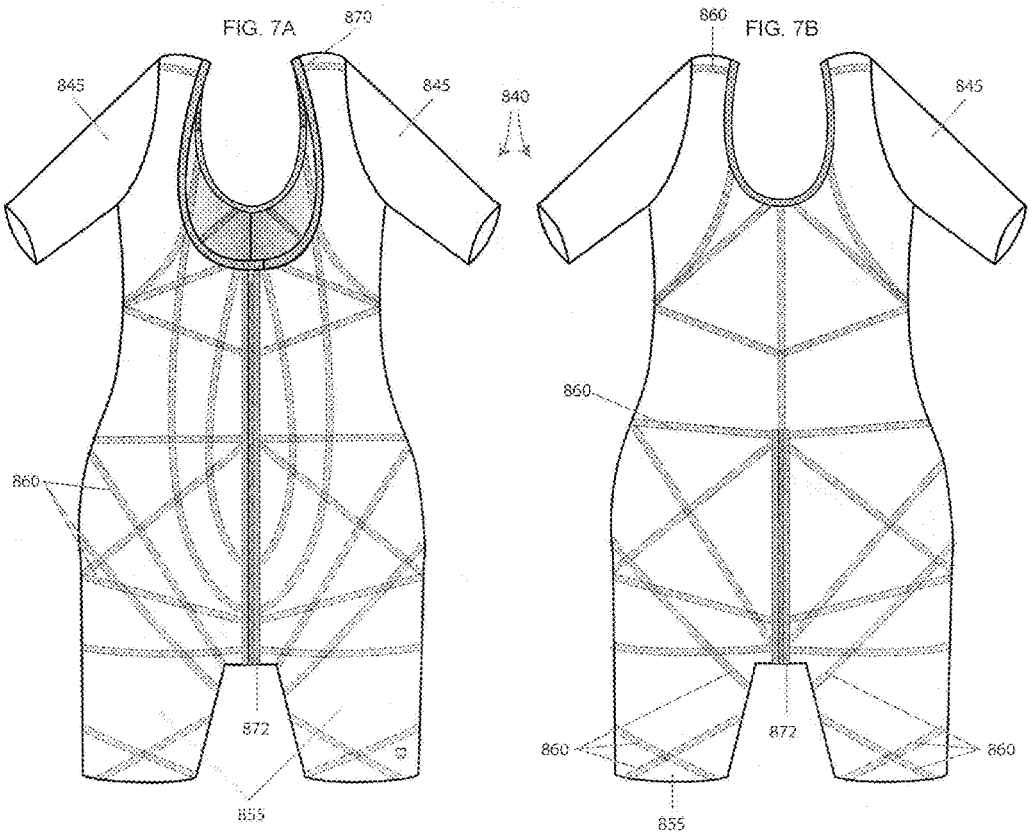
FIGS. 7A-7B are front and rear views of a shapewear garment configured as a body suit with arm sleeves and pant legs according to at least one embodiment described in the present disclosure.

FIGS. 7A-7B depict a front and rear view of another embodiment wherein the shapewear garment 840 including sleeves 845 for receipt of a wearer's arms and further including pant legs 855 for receipt of a wearer's legs. Pant legs 855 further include a plurality of circumferential seams 860*c* wrapping around each individual pant leg 855 in a manner which creates additional circumferential compression on the wearer's legs, and particularly the thighs. As shown, the pant legs 855 would appear to extend along the length of a wearer's thighs, however, the pant legs 855, like the arm sleeves 845, can extend any length from the body. For example, the pant legs 855 may be the length of shorts, capri pants, full length pants, and anywhere therebetween.

Similarly, the length of the arm sleeves 845 may be short sleeve, baseball sleeve (¾ length), long sleeve, and anywhere therebetween.

Figure 7C:
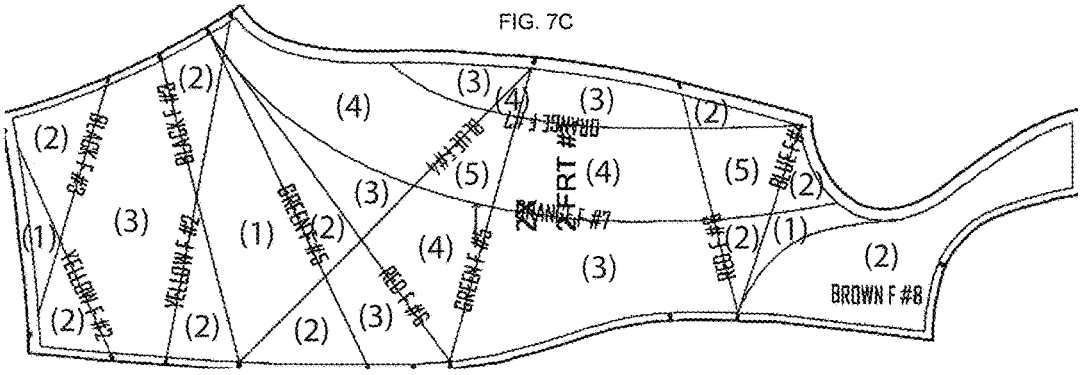
FIGS. 7C-7D are schematic drawings of a shapewear garment configured as a body suit with arm sleeves and pant legs according to at least one embodiment described in the present disclosure.
Figure 7D:
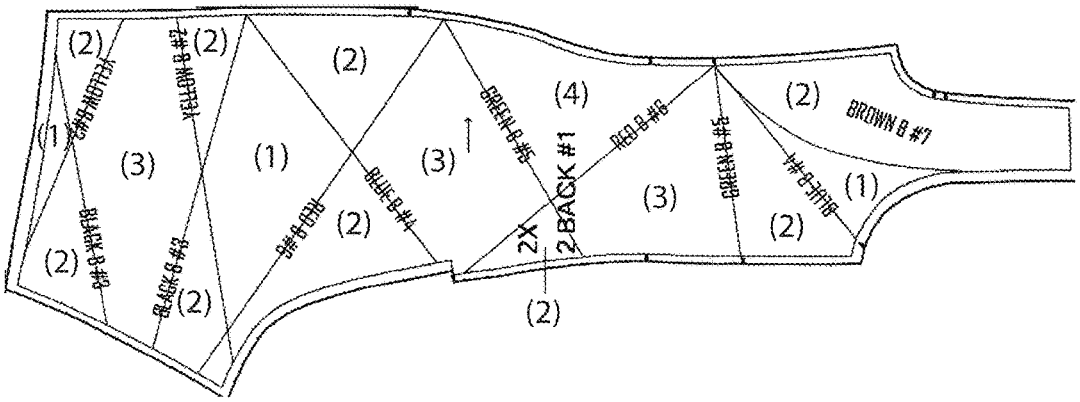

Seams 860 and 860*c* define a plurality of zones, similar in fashion to the zones described herein and/or depicted in the previous figures. FIGS. 7C-7D, similar to FIGS. 1C-1D, depict the respective layers of material included in each zone formed by the seams 860 and/or 860*c*.

Figure 8A:
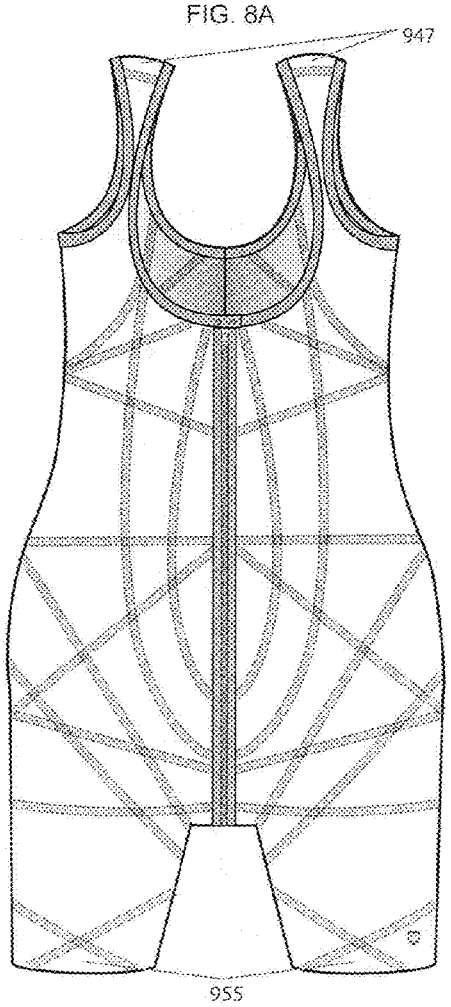
FIGS. 8A-8B are front and rear views of a shapewear garment configured as a body suit with shoulder straps and pant legs according to at least one embodiment described in the present disclosure.
Figure 8A:
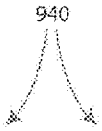
Figure 8B:
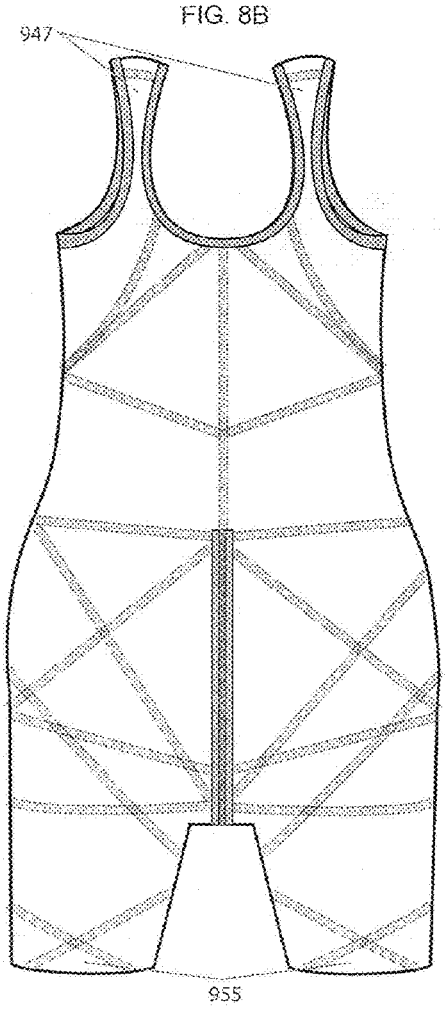

FIGS. 8A-8B depict a front and rear view of another embodiment wherein the shapewear garment 940 is a body suit which includes pant legs 955 for receipt of a wearer's legs and shoulder straps 947 for the passage of a wearer's arm and receipt of the wearer's shoulders. As depicted, the shapewear garment 940 is sleeveless.

Figure 9A:
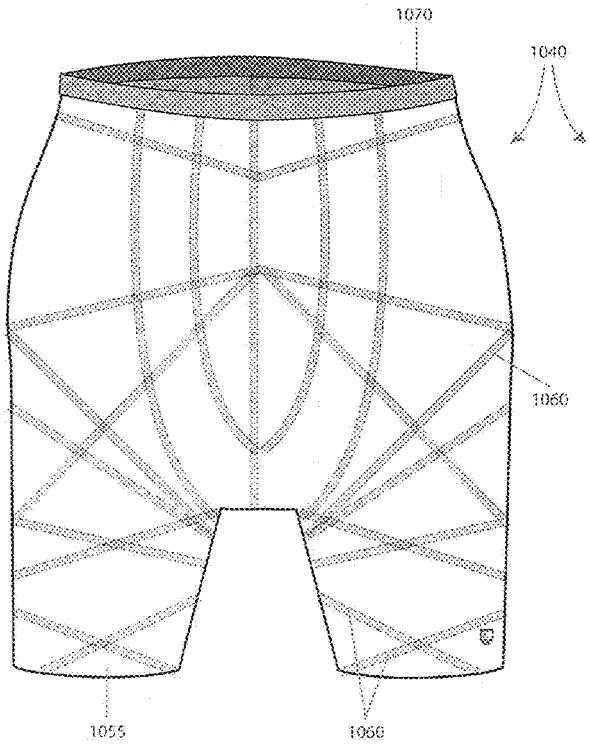
FIGS. 9A-9B are front and rear views of a shapewear garment configured as a pair of pants according to at least one embodiment described in the present disclosure.
Figure 9B:
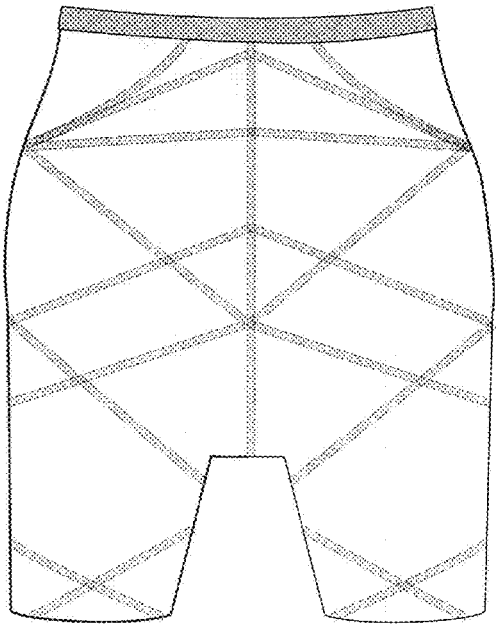

FIGS. 9A-9B depict a front and rear view of another embodiment wherein the shapewear garment 1040 is configured solely as a pair of shorts or pants and including pant legs 1055 with seams 1060 and circumferential seams 1060*c*. Waistband 1070 is also included and may be made from any elastic material and in embodiments may include a belt.

Figure 10:
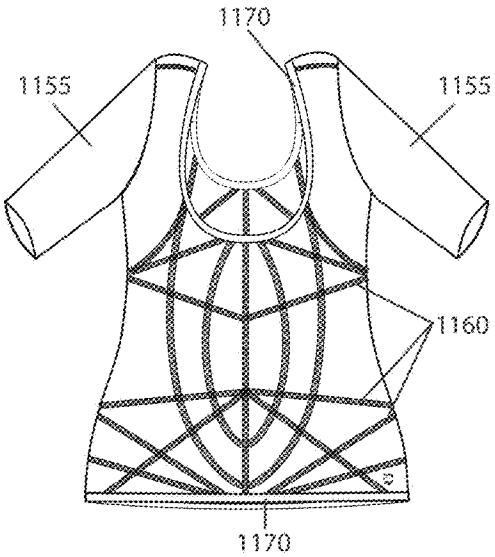
FIG. 10 is a front view of a shapewear garment configured as a shirt or silhouette with sleeves according to at least one embodiment described in the present disclosure.

FIG. 10 depicts a front view of another embodiment wherein the shapewear garment 1140 is configured as a shirt or silhouette including sleeves 1155 with seams 1160. As depicted, sleeves 1155 are free of seams 1160 and may include only one zone throughout. However, it is envisioned that seams 1160 may further be positioned on sleeves 1155 thereby providing sleeves 1155 with a plurality of zones, as described herein. Outer edge 1170 is also included about the openings of the sleeves, neck or torso.

Figure 12A:
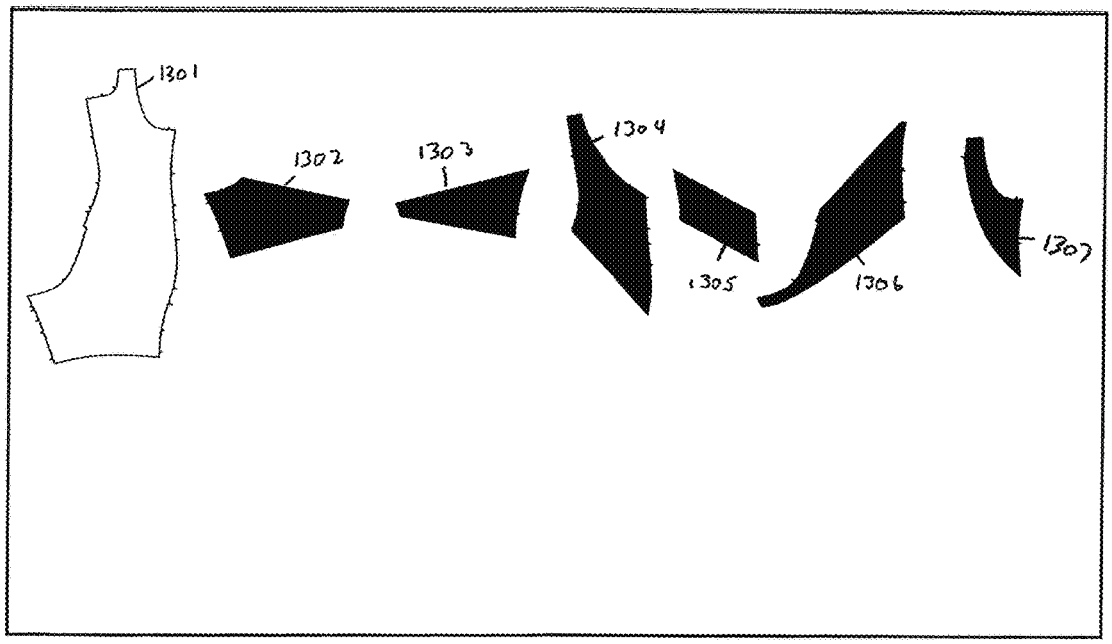
FIGS. 12A and 12B are schematic drawings of a quarter panel of at least body of the shapewear garment according to at least one embodiment described in the present disclosure.
Figure 12B:
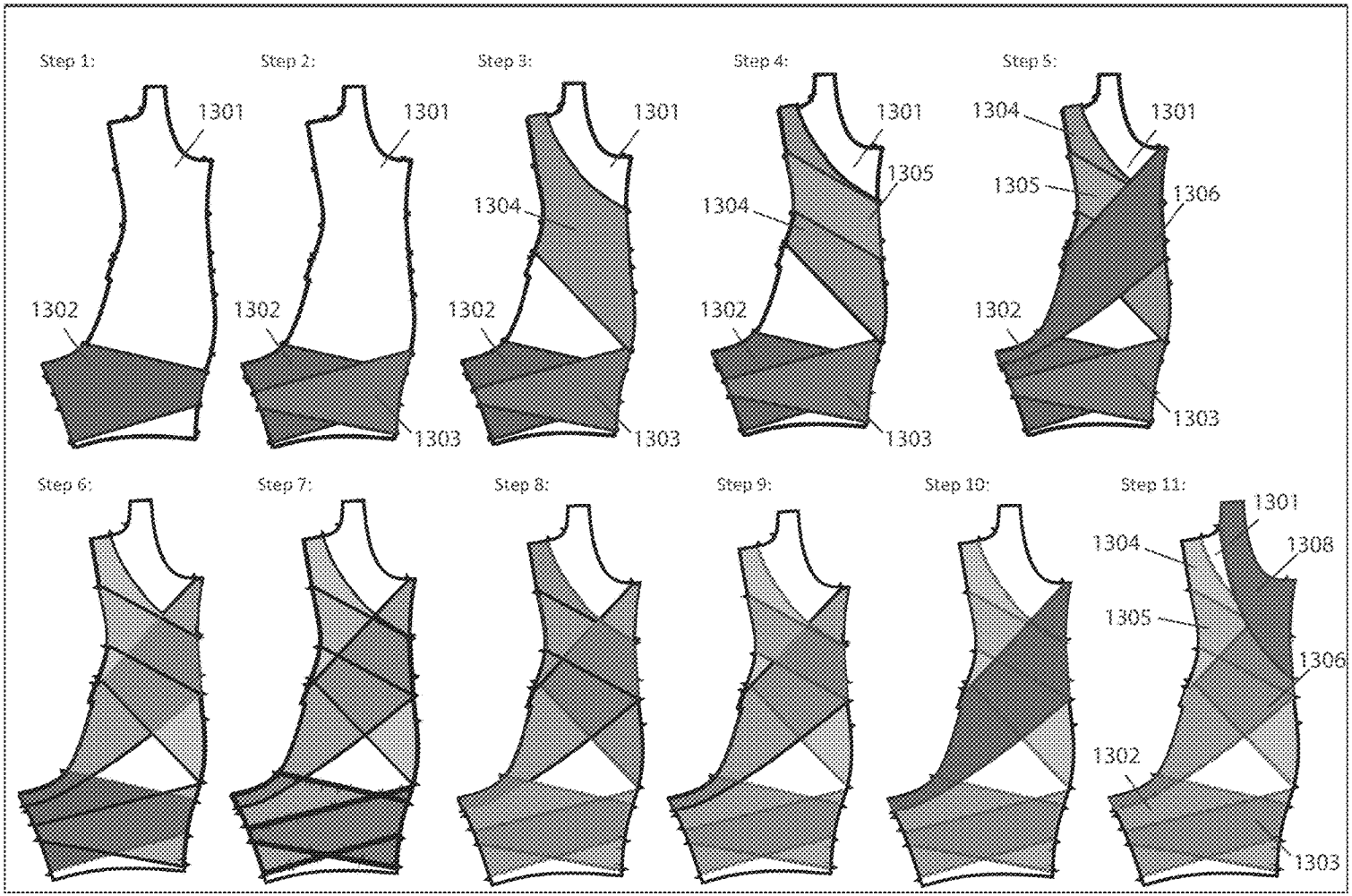

FIGS. 12A and 12B illustrate a quarter panel 1300 of at least one of the bodies described herein of the shapewear garment. Quarter panel 1300 includes seven separate pieces 1301-1307 of at least one layer of the stretchable material described herein. Each of the seven layers 1301-1307 display a different shape.

FIG. 12B illustrates the steps used to combine the seven layers 1301-1307 to create a quarter panel of the body including multiple overlapping layers of stretchable material and seams which divide the layers of material into different zones, wherein the zones have at least one of different shapes, different numbers of layers of material, different compression strength, different appetite control, different porosity, different temperature control, and combinations thereof.

As further shown in FIG. 12B, as each piece 1301-1307 is added to the quarter panel, at least some, if not all, of the pieces are slightly rotated and/or lie in a different orientation to one another relative to the longitudinal elasticity of each piece.

Each of the garment types described herein may be made using similar steps as depicted in FIGS. 12A and 12B. The number of pieces, layers, shapes, orientations, and quarter panel designs may vary depending upon the specific garment type.

In embodiments, a shapewear garment is described including a body including multiple layers of at least one stretchable material, and a plurality of seams which define a plurality of different compression zones on the body. In embodiments, the different compression zones may be symmetrically positioned on the body from front to back, top to bottom, or from left side to right side.

In embodiments, the stretchable material includes at least one of nylon, spandex, and combinations thereof. In embodiments, the stretchable material includes a blend of nylon and spandex, wherein the nylon represents about 60-70% of the stretchable material and the spandex represents about 30-40% of the stretchable material. In embodiments, the blend further comprises an optional material representing about 1-10% and selected from the group consisting of a reinforcing material, a wicking material, a dye, and combinations thereof.

In embodiments, the multiple layers of the body include individual layers stacked one on top of another and made from the same stretchable material. In embodiments, at least some of the individual layers are laid in an orientation different from a neighboring layer relative to a longitudinal elasticity of the individual layers. In embodiments, at least some of the individual layers are rotated from about 45 to about 90 degrees relative to the neighboring layer relative to the longitudinal elasticity of each of the layers.

In embodiments, the plurality of seams of the body pass through and join the multiple layers of stretchable material to define the perimeter of each different compression zone.

In embodiments, the multiple layers of stretchable material are stacked independent of each other across the compression zone.

In embodiments, the compressive force per compression zone may range from 0.1 to 10 pounds per square inch.

In embodiments, the different compression zones are symmetrically distributed across the body by the compressive force per zone.

In embodiments, the different compression zones represent different shapes.

In embodiments, the different compression zones are symmetrically distributed across the body by the shapes of each zone.

In embodiments, the multiple layers of stretchable material vary by number of individual layers in the different compression zones.

In embodiments, the different compression zones are symmetrically distributed across the body by the number of individual layers in each zone.

In embodiments, the body comprises a garment format selected from the group consisting of camisoles, shirts, shorts, pants, body suits, corsets, brassieres, panties, and combinations thereof.

In embodiments, the shapewear garment further comprising an outer edge of the body comprising a material selected from the group consisting of felt, silicone and combinations thereof.

In embodiments, a shapewear garment is described including a body including multiple layers of at least one stretchable material, and a plurality of seams which define a plurality of zones on the body, at least some of the zones having a different shape. In embodiments, the body may include at least 15 zones having a different shape. In embodiments, the differently shaped zones may be symmetrically positioned on the body from front to back, top to bottom, or from left side to right side.

In embodiments, a shapewear garment is described including a body including multiple layers of at least one stretchable material, and a plurality of seams which define a plurality of zones on the body, at least some of the zones having a different number of layers of the at least one stretchable material. In embodiments, the body may include at least 5 zones having a different number of layers. In embodiments, the differently layered zones may be symmetrically positioned on the body from front to back, top to bottom, or from left side to right side.

EXAMPLES

Example 1

A first sample layer including a nylon/spandex blend (69%/31% by weight, respectively) was knitted including an end and pick count (ASTM 3775) of 47 Warps (Wales), 43 Filling (Courses) and a thickness (ASTM D 1777) of 0.0116". The knit fabric was stretch tested (ASTM D 2594) and provided the following characteristics:

| | RECOVERY AFTER 1 MINUTE | | STRETCH (5 LB LOAD) AFTER 60 MINUTES | | | |
|---|---|---|---|---|---|---|
| | Length | Width | Length | Width | Length | Width |
| Specimen #1 | 85.7% | 83.3% | 85.7% | 83.3% | 50.0% | 31.3% |
| #2 | 85.7% | 83.3% | 85.7% | 80.0% | 50.0% | 31.3% |
| #3 | 85.7% | 83.3% | 85.7% | 80.0% | | |
| Average | 85.7% | 83.3% | 85.7% | 81.1% | 50% | 31.3% |

Example 2

A second layer including a polyamide/spandex blend (69%/31% by weight, respectively) was formed. The bursting strength, thickness, stretch and recovery of the second layer were tested and the following results collected:

Bursting Strength:
Test Method: ASTM D3787:2007 (2011)
Average Bursting Strength=30.6 (lbf)
Thickness:
Test Method: ASTM D1777: 2011 e1
Average Thickness=0.23 mm
Stretch and Recovery:
Test Method: ASTM D2594:2004 (2012)
Stretch and Growth % at 5 lb Load
Average Wale %=57.4
Average Course %=66.6
Fabric Growth after Stretched to Specified Extension
After 1 min.
Average Wale %=0.8
Average Course %=4.0
After 1 hour
Average Wale %=0.4
Average Course %=1.8
Fabric Recovery after Stretched to Specified Extension
After 1 min.
Average Wale %=97.3
Average Course %=86.7
After 1 hour
Average Wale %=98.7
Average Course %=93.9
Bench mark=125 mm+/−3 mm Although many of the embodiments illustrated in the FIGURES depicts a pair of sleeves, pants, straps, etc., the shapewear garments described herein may also include only one sleeve, pant, strap, etc. It is further envisioned that the shapewear garment may be configured to include a brassiere or bralette and/or configured to include some form of a halter top across the chest area of the wearer. It is still further envisioned that any structure depicted and/or described herein in any embodiment, may be included in any additional embodiments wherein it might not have been specifically described and/or depicted.

While the foregoing description and drawings represent an illustrative embodiment of the present invention, it will be understood that various additions, modifications, and substitutions may be made therein without departing from the spirit and scope of the present invention as defined in the accompanying claims. Therefore, the present invention is not limited to only the embodiments specifically described herein. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A shapewear garment comprising:

a body including multiple layers of at least one stretchable material, the multiple layers including individual layers stacked one on top of another and made from the same stretchable material, at least some of the individual layers laid at an acute angle in relation to a neighboring layer relative to a longitudinal elasticity of the individual layers; and a plurality of seams which define a plurality of different compression zones on the body, wherein the plurality of seams pass through and join all layers of the multiple layers along a perimeter of each different compression zone.

2. The shapewear garment of claim 1, wherein the stretchable material comprises at least one of nylon, spandex, and combinations thereof.

3. The shapewear garment of claim 1, wherein the stretchable material comprises a blend of nylon and spandex, wherein the nylon represents about 60-70% of the stretchable material and the spandex represents about 30-40% of the stretchable material.

4. The shapewear garment of claim 3, wherein the blend further comprises an optional material representing about 1-10%.

5. The shapewear garment of claim 4, wherein the optional material comprises at least one of a reinforcing material, a wicking material, a dye, and combinations thereof.

6. The shapewear garment of claim 1, wherein at least some of the individual layers are rotated from about 45 to about 90 degrees relative to the neighboring layer relative to the longitudinal elasticity of each of the layers.

7. The shapewear garment of claim 1, wherein the multiple layers of stretchable material are independent of each other across the compression zone.

8. The shapewear garment of claim 1, wherein a compressive force per compression zone may range from 0.1 to 10 pounds per square inch.

9. The shapewear garment of claim 8, wherein the different compression zones are symmetrically distributed across the body by the compressive force per zone.

10. The shapewear garment of claim 1, wherein the different compression zones comprises different shapes.

11. The shapewear garment of claim 10, wherein the different compression zones are symmetrically distributed across the body by the shapes of each zone.

12. The shapewear garment of claim 1, wherein the multiple layers of stretchable material vary by number of individual layers in the different compression zones.

13. The shapewear garment of claim 12, wherein the different compression zones are symmetrically distributed across the body by the number of individual layers in each zone.

14. The shapewear garment of claim 1, wherein the body comprises a garment format selected from the group consisting of camisoles, shirts, shorts, pants, body suits, corsets, brassieres, panties, and combinations thereof.

15. The shapewear garment of claim 1, further comprising an outer edge of the body comprising a material selected from the group consisting of felt, silicone and combinations thereof.

16. The shapewear garment of claim 1, further comprising a zipper which extends from a center of a front of the body to a center of a back of the body, wherein the zipper is connected to the plurality of different compression zones.

17. The shapewear garment of claim 1, wherein each seam comprises 10-30 stitches per inch.

* * * * *